US006398310B1

(12) United States Patent
Seeliger

(10) Patent No.: US 6,398,310 B1
(45) Date of Patent: Jun. 4, 2002

(54) ANATOMICALLY SHAPED SEAT SHELL AND ASSOCIATED METHOD OF CONSTRUCTION

(75) Inventor: Klaus Seeliger, Kassol (DE)

(73) Assignee: Otto Bock Orthopaedische Industrie Besitz-und Verwaltungs GmbH & Co. KG, Duderstadt (DE)

( * ) Notice: Subject to any disclaimer, the term of this patent is extended or adjusted under 35 U.S.C. 154(b) by 0 days.

(21) Appl. No.: 09/666,187

(22) Filed: Sep. 21, 2000

(30) Foreign Application Priority Data

Sep. 22, 1999 (DE) ..... 199 45 379

(51) Int. Cl.[7] ..... A47C 7/22

(52) U.S. Cl. ..... 297/452.21; 297/452.25; 297/452.63

(58) Field of Search ..... 297/452.21, 452.23, 297/452.25, 452.63

(56) References Cited

U.S. PATENT DOCUMENTS

| | | | | | |
|---|---|---|---|---|---|
| 2,812,146 | A | * | 10/1957 | Chaplin | 297/452.63 X |
| 2,995,182 | A | * | 8/1961 | Hendrickson | 297/452.63 X |
| 3,021,176 | A | * | 2/1962 | Eads et al. | 297/452.63 |
| 3,046,005 | A | * | 7/1962 | Raduns | 297/452.63 X |
| 3,088,773 | A | * | 5/1963 | Horrocks et al. | 297/452.63 X |
| 3,464,479 | A | * | 9/1969 | Baker | 297/452.63 X |
| 3,476,169 | A | * | 11/1969 | Militano | 297/452.63 X |
| 3,565,487 | A | * | 2/1971 | Reiter | 297/452.63 |
| 3,584,675 | A | * | 6/1971 | Borichevsky | 297/452.63 X |
| 3,749,442 | A | * | 7/1973 | Berg et al. | 297/452.25 X |
| 4,643,481 | A | * | 2/1987 | Saloff et al. | 297/452.25 |
| 5,457,833 | A | * | 10/1995 | Jay | 297/452.25 X |
| 5,522,106 | A | * | 6/1996 | Harrison et al. | 297/452.25 X |
| 5,941,547 | A | | 8/1999 | Drake | |
| 5,957,532 | A | * | 9/1999 | Watkins | 297/452.63 X |
| 6,139,109 | A | * | 10/2000 | Lajoie | 297/452.25 X |

FOREIGN PATENT DOCUMENTS

| | | |
|---|---|---|
| DE | 44 05 595 | 6/1995 |
| DE | 196 17 912 | 7/1997 |
| DE | 198 14 067 | 10/1998 |

* cited by examiner

*Primary Examiner*—Peter M. Cuomo
*Assistant Examiner*—Rodney B. White
(74) *Attorney, Agent, or Firm*—Husch & Eppenberger, LLC; Robert E. Muir; Richard J. Musgrave

(57) ABSTRACT

An anatomically shaped seat shell includes a first lateral profile and a second lateral profile with a longitudinal axis located between the first lateral profile and the second lateral profile, a median support located edgeways to the longitudinal axis of the scat shell and having an upper edge portion and a lower edge portion and seat bands located transverse to the median support and connected to the upper edge portion of the median support, the first lateral profile and the second lateral profile. A method of construction is also disclosed. By automatically adjusting the seat bands to the individual profile of the buttocks or posterior of a user, a high sitting stability and a high evenness of the distribution of sitting pressure are achieved. The distance of the seat bands from one another, in combination with an open-pore cellular material pad cut to the same thickness, provides a very good microclimate. For large series products, such as office chairs, car and airplane seats, manufacture of the seat shell is provided from one piece. By using carrying bands, there is a foldable version of the seat shell, which can be used instead of the suspended belt in all wheelchairs.

21 Claims, 1 Drawing Sheet

Fig.1
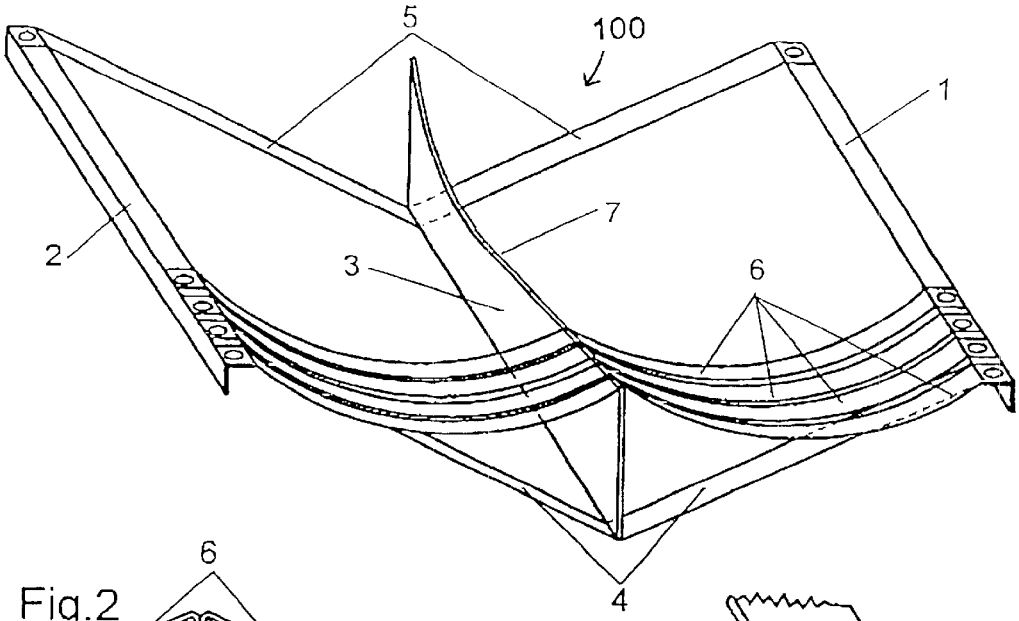
Fig.2
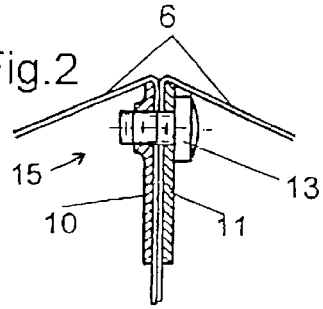
Fig.4
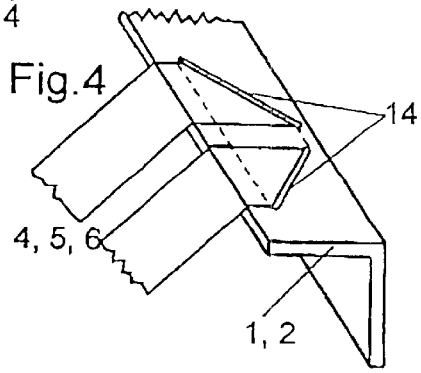
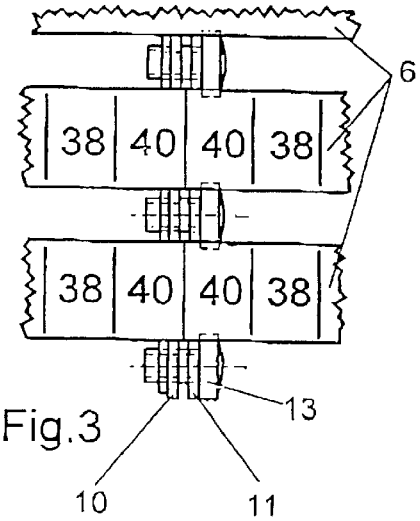
Fig.3
Fig.5
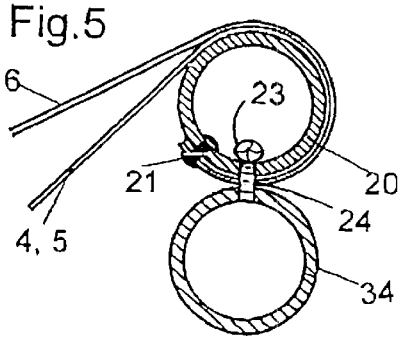
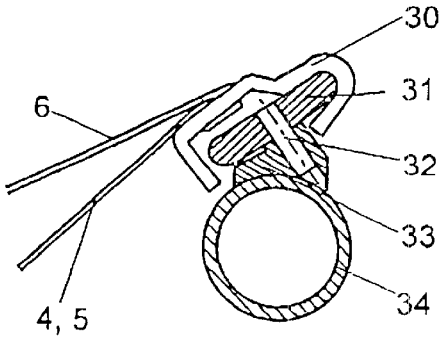
Fig.6

ANATOMICALLY SHAPED SEAT SHELL AND ASSOCIATED METHOD OF CONSTRUCTION

BACKGROUND OF THE INVENTION

The invention relates to an anatomically shaped seat shell and associated method of construction. Seat shells that are adjusted to the anatomy of the human buttocks or posterior improve sitting stability and reduce the pressure on certain points which usually occurs under the protuberances of the seat bone of the buttocks or posterior. One example of these is the tractor seat, a seat shell molded from sheet steel and perforated. Individually adjusted seat shells, e.g. according to the Shape System of Otto Bock or according to the Silhouette method of Invacaro, offer almost perfect leveling of sitting pressure over the whole sitting area, which is required in difficult cases such as that found in the domain of wheelchairs. In German publications, DE 4405595 and DE 19617912, a further method of this kind is described. However, individually adjusted seat shells of this kind are not suitable or practical for general use.

The present invention is directed to overcoming one or more of the problems set forth above.

SUMMARY OF THE INVENTION

In an aspect of this invention, an anatomically shaped seat shell is disclosed. This seat shell includes a first lateral profile and a second lateral profile with a longitudinal axis located between the first lateral profile and the second lateral profile, a median support located edgeways to the longitudinal axis of the seat shell and having an upper edge portion and a lower edge portion, and a plurality of seat bands located transverse to the median support and connected to the upper edge portion of the median support, the first lateral profile and the second lateral profile.

In another aspect of this invention, a method of creating an anatomically shaped seat shell is disclosed. The method includes utilizing a first lateral profile, a second lateral profile, with a longitudinal axis located between the first lateral profile and the second lateral profile, locating a median support edgeways to the longitudinal axis of the seat shell and having an upper edge portion and a lower edge portion, and attaching a plurality of seat bands transverse to the median support and connected to the upper edge portion of the median support, the first lateral profile and the second lateral profile.

Yet another aspect of the invention is to produce an anatomically shaped seat shell for general use. It is based on the fact that while a suspended belt, customary with folding chairs and wheelchairs, can be adjusted to the shape of the buttocks or posterior to some extent, this adjustment is inadequate because it bends one-dimensionally and produces a non-physiological pressure on the trochanter of the person sitting in the chair. Above all, though, the lowest points of the suspended belt are located in the median plane (which divides the human body into a left and right half). In contrast, the lowest points of an anatomically shaped seat shell are located underneath the two seat bone protuberances and underneath the two thighs. In this Invention, the sitting area is divided up into a plurality of seat bands located transversely to the median plane with a slightly different length thereof allows a three-dimensional sitting area. A median support is provided to that the upper edge of the median support raises the plurality of seat bands in the median plane, so the lowest points of the seat shell defined by the plurality of seat bands are moved outwards out of the median plane to underneath the seat bone protuberances and underneath the thighs. What is particularly remarkable is the fact that these lowest points are automatically set at the right point under the weight of the person sitting in the seat, with both broad and narrow buttocks or posterior. This circumstance enables the upper edge of the median support and the length of the seat bands to be designed so that it can accommodate ninety-five percent (95%) of all possible female posteriors.

BRIEF DESCRIPTION OF THE DRAWINGS

Reference is now made more particularly to the drawings that illustrate the best presently known mode of carrying out the invention and wherein similar reference characters indicate the same parts throughout the views.

FIG. 1 illustrates a perspective view of the seat shell of the present invention;

FIG. 2 is a cross-sectional view of a particular configuration of the median support;

FIG. 3 is a partial plan view of the configuration shown in FIG. 2;

FIG. 4 is perspective view of a particular fastening of the carrying bands and the seat bands on the lateral profiles;

FIG. 5 is a cross-sectional view of round lateral profile; and

FIG. 6 is a cross-sectional view of a particular lateral profile, by which the seat shell is longitudinally displaceable for the purpose of altering the position of the seat.

DETAILED DESCRIPTION

Referring now to the drawings and initially to FIG. 1, the basic structure of the seat shell is illustrated and generally indicated by numeral 100. It includes a left or first lateral profile 1, a right or second lateral profile 2, a median support 3 and a plurality of seat bands 6. The median support 3 is located in a median plane located between the first and the second lateral profiles 1, 2. An illustrative, but nonlimiting example, only the front four scat bands 6 are illustrated in FIG. 1. Additional seat bands (not shown) adjoin the four illustrated seat bands 6, in order to cover the whole sitting area. In the preferred situation, where this seat shell 100 also needs to be foldable in order to use it, such as for example, in the domain of wheelchairs, front carrying bands 4 and rear carrying bands 5 are provided, which support the median support 3 on the lower longitudinal edge of the median support 3. Assembly of this foldable seat shell 100 is done by fastening the first and second lateral profiles 1 and 2 on seat tube 34, as shown in FIGS. 5 and 6, of a wheelchair (not shown) with screws 23. Assembly of the seat shell 100 for car or airplane seats is done in a similar manner. Office chairs that have a central foot or adjusting mechanism with the first and second lateral profiles 1 and 2 and the median support 3 rigidly connected thereto. In this application of office chairs, the carrying bands 4 and 5 are dispensed with. The carrying bands 4 and 5 and the plurality of seat bands 6 are fastened to the first and second lateral profiles 1 and 2 and to the median support 3 by screwing, riveting, clamping, gluing, welding or another known means of attachment.

In large scale production operations, the plurality of seat bands 6, the first and second lateral profiles 1 and 2 and the median support 3 can be manufactured in one piece in an injection molding process. Also, the connecting elements, such as the carrying bands 4 and 5 can also be a part of this same unitary structure. All the fastenings previously mentioned can be dispensed with by this unitary structure. The first and second lateral profiles 1 and 2 can also be extended into a frame on which the median support 3 is suspended.

Because the seat shell 100, according to the invention, adjusts so well to the respective anatomy of the buttocks or posterior, a cellular material cushion (not illustrated) placed on the plurality of seat bands 6 can be flatter than normal and thus improve the sitting stability of the user. The distance of the seat bands 6 from one another, the open-pore structure of the cellular material cushion and the small thickness thereof provide high air and water vapor permeability and thus an advantageous microclimate of the seat. This permeability is a weak point in all car seats foamed in the mould, because the surface produced during the manufacturing process impedes the transport of air and water vapor. Therefore, this Invention results in a cooler and more comfortable seat.

Further development of the invention is concerned with the special case of seat shells 100 for wheelchairs and the adjustment required for the different width measurements of the wheelchairs. FIG. 2 shows the median support 3, having a clamping mechanism, generally indicated by numeral 15, adjacent an upper edge 7 of the median support 3. The clamping mechanism 15 is divided into a first half clamping piece 10 and a second half clamping piece 11 between which the carrying bands 4 and 5 and the seat bands 6, which are adjusted in length for similar, if not identical contour, and then clamped tight by means of the screws 13 that connects the two half clamping pieces 10 and 11, respectively.

FIG. 3 shows a detail from the plan of the seat shell 100. It can be seen here how the seat bands 6 are printed with graduation marks and numbers 38 and 40 relating to the width of the seat of the wheelchair, which simplify width adjustment of the seat shell 100. The carrying bands 4 and 5 are printed in the same way. The printing on the individual scat bands 6 is not completely identical due to the fact that the seat bands 6 sag to slightly different extents to give optimal adjustment to the shape of the buttocks or posterior. The space, for example, between the graduation marks on the seat band 6 located under the seat bone protuberances is slightly greater. A seat shell 100 set-up in this manner, to the required width, with a foam material cushion placed on top will have very even distribution of pressure compared with a suspended belt found in a typical wheel chair.

If, however, in an individual situation, pressure is felt or measured at a certain point, the seat band 6 located at this point can be slightly lengthened after loosening the adjacent screws 13, leading to immediate reduction in the pressure at that point. The seat shell 100 according to the invention can be altered not only in its width, however, but also in its length. For this purpose the two half clamping pieces 10 and 11 of the median support 3 and the first and second lateral profiles 1 and 2 are shortened at the front ends by two or four seat bands by sawing or with a sheet metal cutter. If this option is applied, the front carrying bands 4 are displaced backwards by four band spaces.

FIG. 4 illustrates a particular fastening of the carrying bands 4 and 5 and the seat bands 6 on the first and second lateral profiles 1 and 2. In this illustrative, but nonlimiting example, slots 14 stamped in the first and second lateral profiles 1 and 2 at forty-five degrees (45°), through which a band 4, 5, or 6, respectively is threaded in and after two forty-five degree (45°) angle folds is threaded out again.

FIG. 5 illustrates a tube-shaped version as lateral profile 20. In this embodiment, the carrying bands 4 or 5, respectively, and the plurality of seat bands 6 are wound on to the tube-shaped lateral profile 20 and fastened with blind rivets 21, for example. Several through holes, such as illustrated by numeral 24, located on the periphery, then allow fastening by screws 23, e.g. on the seat tubes 34 of the wheelchair, and adjustment of the width of the seat shell 100, depending which through holes 24 are used.

Finally, FIG. 6 is a lateral profile version 30 mounted on rollers 31, the spindles 32 of the rollers 31 are placed on pillow blocks 33 screwed onto the seat tube 34 of a wheelchair. The oblique position of the arrangement results from the tensile stresses in the carrying bands 4 and 5, respectively and the plurality of seat bands 6. By means of this arrangement, the seat shell 100 according to the invention can be pushed along the seat tube 34 of the wheelchair and thus enable the "Dynamic Sitting in a Wheelchair" (e.g. OS DE 19814067) known to the person skilled in the art. The manual or servodrive actuation elements required are known and do not need to be mentioned here. A typical wheelchair is disclosed in U.S. Pat. No. 5,941,547 that issued on Aug. 24, 1999, the disclosure of which is hereby incorporated by reference.

Packing belts of stretched and embossed polypropylene normally used in the trade have proved their suitability as semi-finished products for the carrying bands 5 and 6, respectively, and the plurality of seat bands 6, these having a high tear strength. They are, though, sufficiently pliable for the seat shell 100 according to the invention, made from the seat bands 6, to adjust to the respective anatomy of the buttocks or posterior and in the special case of wheelchairs can be folded without difficulty.

What is claimed is:

1. An anatomically shaped seat shell comprising:

a first lateral profile and a second lateral profile with a median plane located between said first lateral profile and said second lateral profile;

a rigid median support in the median plane of said seat shell and having an upper edge portion and a lower edge portion;

a plurality of seat bands located transverse to said rigid median support and connected to said upper edge portion of said median support, said first lateral profile and said second lateral profile; and wherein said rigid median support raises said seat bands to anatomically conform to an individual's posterior.

2. The anatomically shaped seat shell of claim 1, wherein said plurality of seat bands are located substantially close to each other.

3. The anatomically shaped seat shell of claim 1, wherein said median support anatomically conforms to an individual's posterior.

4. The anatomically shaped seat shell of claim 1, wherein a combination of said plurality of seat bands, said first lateral profile, said second lateral profile, and said median support is a unitary structure.

5. The anatomically shaped scat shell of claim 1, further including at least one carrying band that is attached to said first lateral profile and said second lateral profile and is located below said lower edge portion of said median support.

6. The anatomically shaped seat shell of claim 5, wherein a combination of said plurality of seat bands, said first lateral profile, said second lateral profile, said at least one carrying band and said median support is a unitary structure.

7. The anatomically shaped seat shell of claim 5, further includes a clamping mechanism associated with said median support for securing said plurality of seat bands and said at least one carrying band.

8. The anatomically shaped seat shell of claim 7, wherein said clamping mechanism is adjustable to vary length of the plurality of seat bands and said at least one carrying band secured therein to accommodate different posterior sizes.

9. The anatomically shaped seat shell of claim 5, wherein said at least one carrying band has graduation indicia located thereon that correspond to seat widths for wheelchairs.

10. The anatomically shaped seat shell of claim 5, wherein said first lateral profile includes oblique slots located therein and said second lateral profile includes oblique slots located therein for securing said plurality of seat bands and said at least one carrying band to said first lateral profile and said second lateral profile.

11. The anatomically shaped seat shell of claim 1, further includes a first carrying band that is attached to a first end portion of said first lateral profile and a first end portion of said second lateral profile and is located below said lower edge portion of said median support and includes a second carrying band that is attached to a second end portion of said first lateral profile and a second end portion of said second lateral profile and is located below said lower edge portion of said median support.

12. An anatomically shaped seat shell comprising:

a first lateral profile and a second lateral profile with a median plane located between said first lateral profile and said second lateral profile;

a rigid median support in the median plane of said seat shell and having an upper edge portion and a lower edge portion;

a plurality of seat bands located transverse to said rigid median support and connected to said upper edge portion of said median support, said first lateral profile and said second lateral profile;

a clamping mechanism associated with said median support for securing said plurality of seat bands; and wherein said rigid median support raises said scat bands to anatomically conform to an individual's posterior.

13. The anatomically shaped scat shell of claim 12, wherein said clamping mechanism is adjustable to vary length of the plurality of seat bands secured therein to accommodate different posterior sizes.

14. An anatomically shaped seat shell comprising:

a first lateral profile and a second lateral profile with a median plane located between said first lateral profile and said second lateral profile;

a rigid median support in the median plane of said seat shell and having an upper edge portion and a lower edge portion;

a plurality of seat bands located transverse to said rigid median support and connected to said upper edge portion of said median support, said first lateral profile and said second lateral profile, the plurality of seat bands having graduation indicia located thereon that correspond to seat widths for wheelchairs; and wherein said rigid median support raises said seat bands to anatomically conform to an individual's posterior.

15. An anatomically shaped seat shell comprising:

a first lateral profile and a second lateral profile with a median plane located between said first lateral profile and said second lateral profile;

a rigid median support in the median plane of said seat shell and having an upper edge portion and a lower edge portion;

a plurality of seat bands located transverse to said rigid median support and connected to said upper edge portion of said median support, said first lateral profile and said second lateral profile;

wherein said first lateral profile includes at least one oblique slot located therein and said second lateral profile include at least one oblique slot located therein for securing said plurality of seat bands to said first lateral profile and said second lateral profile; and wherein said rigid median support raises said seat bands to anatomically conform to an individual's posterior.

16. An anatomically shaped seat shell comprising:

a first lateral profile and a second lateral profile with a median plane located between said first lateral profile and said second lateral profile;

a rigid median support in the median plane of said seat shell and having an upper edge portion and a lower edge portion;

a plurality of seat bands located transverse to said rigid median support and connected to said upper edge portion of said median support, said first lateral profile and said second lateral profile;

wherein said first lateral profile is substantially round and includes at least one rivet located therein and said second lateral profile is substantially round and includes at least one rivet located therein for securing said plurality of seat bands to said first lateral profile and said second lateral profile; and wherein said rigid median support raises said seat bands to anatomically conform to an individual's posterior.

17. The anatomically shaped seat shell of claim 16, wherein said first lateral profile is attached to a first tube associated with a wheel chair and said second lateral profile is attached to a second tube associated with a wheel chair.

18. An anatomically shaped seat shell comprising:

a first lateral profile and a second lateral profile with a median plane located between said first lateral profile and said second lateral profile;

a rigid median support in the median plane of said seat shell and having an upper edge portion and a lower edge portion;

at least one carrying band that is attached to said first lateral profile and said second lateral profile and is located below said lower edge portion of said median support;

a plurality of seat bands located transverse to said rigid median support and connected to said upper edge portion of said median support, said first lateral profile and said second lateral profile;

wherein said first lateral profile is substantially round and includes at least one rivet located therein and said second lateral profile is substantially round and includes at least one rivet located therein for securing said plurality of seat bands and said at least one carrying band to said first lateral profile and said second lateral profile; and wherein said rigid median support raises said seat bands to anatomically conform to an individual's posterior.

19. An anatomically shaped seat shell comprising:

a first lateral profile and a second lateral profile with a median plane located between said first lateral profile and said second lateral profile;

a rigid median support in the median plane of said seat shell and having an upper edge portion and a lower edge portion;

a plurality of seat bands located transverse to said rigid median support and connected to said upper edge portion of said median support, said first lateral profile and said second lateral profile;

wherein said rigid median support raises said seat bands to anatomically conform to an individual's posterior; and further including a first support mechanism including a first roller wherein said first lateral profile is movably attached thereto, wherein said first roller is attached to a first spindle and said first spindle is attached by a first pillow block that can be secured to a first tube that can be associated with a wheel chair and further including a second support mechanism including a second roller wherein said second lateral profile is movably attached thereto, wherein said second roller is attached to a second spindle and said second spindle is attached by a second pillow block that can be secured to a second tube that can be associated with said wheel chair.

20. A method of creating an anatomically shaped seat shell comprising the steps of:

utilizing a first lateral profile, a second lateral profile, with a median plane located between said first lateral profile and said second lateral profile;

locating a rigid median support in the median plane of said seat shell and having an upper edge portion and a lower edge portion;

attaching a plurality of seat bands transverse to said rigid median support and connected to said upper edge portion of said median support, said first lateral profile and said second lateral profile; and supporting anatomically an individual's posterior by raising the seat bands via the rigid median support.

21. The method of creating an anatomically shaped seat shell of claim 20, further including the step of attaching at least one carrying band to said first lateral profile and said second lateral profile that is located below said lower edge portion of said medium support.

* * * * *